US005720651A

United States Patent [19]

Chien

[11] Patent Number: 5,720,651

[45] Date of Patent: Feb. 24, 1998

[54] ILLUMINATED NON-MOTOR POWERED FLYING DEVICE

[76] Inventor: Tseng Lu Chien, 2R, No. 29, Alley 93, Liu-Shen Street, Shi-Chi Town, Taipei Hsang, Taiwan

[21] Appl. No.: 444,064

[22] Filed: May 18, 1995

[51] Int. Cl.[6] ..... A63H 27/00; A63H 27/127; A63H 33/26

[52] U.S. Cl. ..... 446/34; 200/61.19; 200/61.45 R; 200/61.48; 200/61.51; 273/58 G; 446/36; 446/61; 446/219; 446/485

[58] Field of Search ..... 362/84; 200/61.45 R, 200/61.51, 61.52, 61.48, 61.19, 506; 273/58 G, 58 K, 346, 412, 416; 446/34, 36, 47, 48, 219, 242, 485; 218/1, 89

[56] References Cited

U.S. PATENT DOCUMENTS

| | | | |
|---|---|---|---|
| 2,634,407 | 4/1953 | Johnson . | |
| 2,809,833 | 10/1957 | Slade | 446/219 X |
| 2,849,819 | 9/1958 | Murphy et al. . | |
| 2,959,892 | 11/1960 | Johnson . | |
| 2,983,800 | 5/1961 | Rabinow | 200/61.45 R |
| 3,053,949 | 9/1962 | Johnson . | |
| 3,153,745 | 10/1964 | Gurian et al. | 273/58 G |
| 3,284,941 | 11/1966 | Kaup . | |
| 3,351,347 | 11/1967 | Smith et al. | 273/58 G |
| 3,740,543 | 6/1973 | Franc | 446/485 X |
| 4,135,324 | 1/1979 | Miller et al. | 446/47 |
| 4,158,922 | 6/1979 | Dana, III . | |
| 4,412,205 | 10/1983 | Von Kemenczky . | |
| 4,435,917 | 3/1984 | Lee | 446/47 |
| 4,595,200 | 6/1986 | Shishido . | |
| 4,701,146 | 10/1987 | Swenson . | |
| 4,864,473 | 9/1989 | Tokarz et al. | 362/84 |
| 5,058,900 | 10/1991 | Denen | 273/416 |
| 5,067,063 | 11/1991 | Granneman et al. . | |
| 5,080,362 | 1/1992 | Lillard . | |
| 5,151,678 | 9/1992 | Vetri et al. . | |
| 5,157,405 | 10/1992 | Wycoff et al. | 273/416 X |
| 5,163,647 | 11/1992 | Fader et al. | 446/34 X |
| 5,230,650 | 7/1993 | Brayton | 446/219 X |
| 5,245,516 | 9/1993 | de Haas et al. . | |
| 5,319,531 | 6/1994 | Kutnyak | 446/47 X |
| 5,344,155 | 9/1994 | Huang | 273/58 K X |

FOREIGN PATENT DOCUMENTS

| | | | |
|---|---|---|---|
| 5228265 | 9/1993 | Japan | 446/47 |

*Primary Examiner*—Robert A. Hafer
*Assistant Examiner*—D. Neal Muir
*Attorney, Agent, or Firm*—Bacon & Thomas

[57] ABSTRACT

A non-motor powered flying device of the type designed to be thrown, kicked, hit, or otherwise propelled by the user, includes a lighting arrangement in the form of a super-thin lighting element such as an electro-luminescent or photo-luminescent strip or panel. In the case of an electro-luminescent strip or panel, the power supply is positioned so as to enhance or at least not interfere with the flying properties of the object or device, and may include a specially designed spring-based motion sensitive switch which can be deactivated by inserting a straw-like member between the poles of the switch.

23 Claims, 8 Drawing Sheets

FIG. 6C
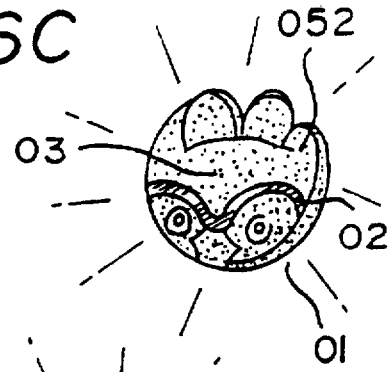
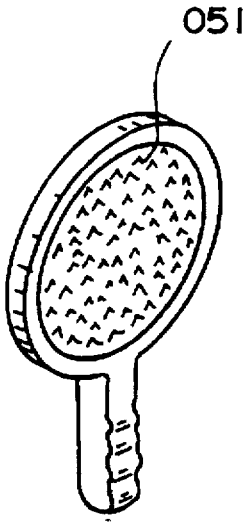
FIG. 6B
FIG. 6D
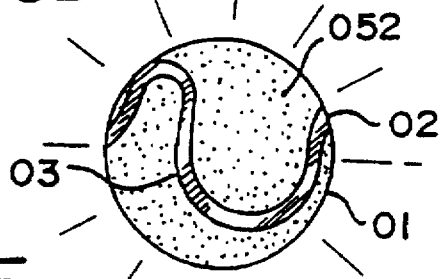
FIG. 6E
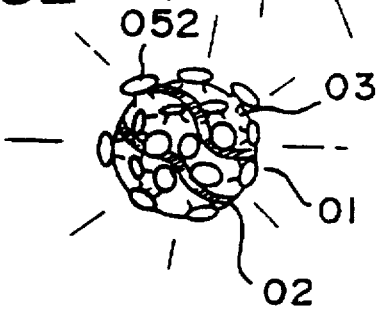
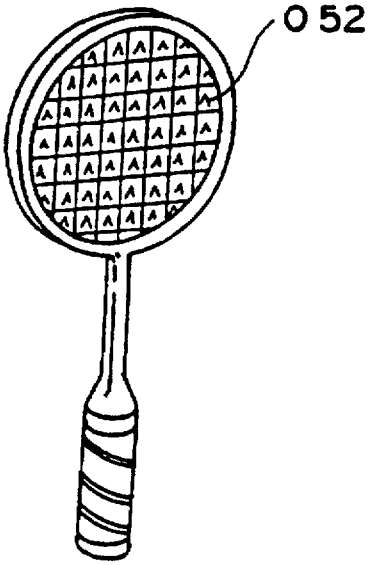
FIG. 6A
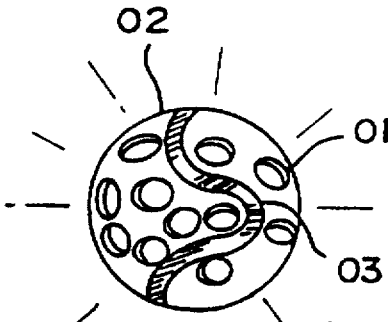
FIG. 6F
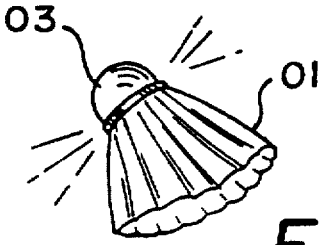
FIG. 6G FIG. 8
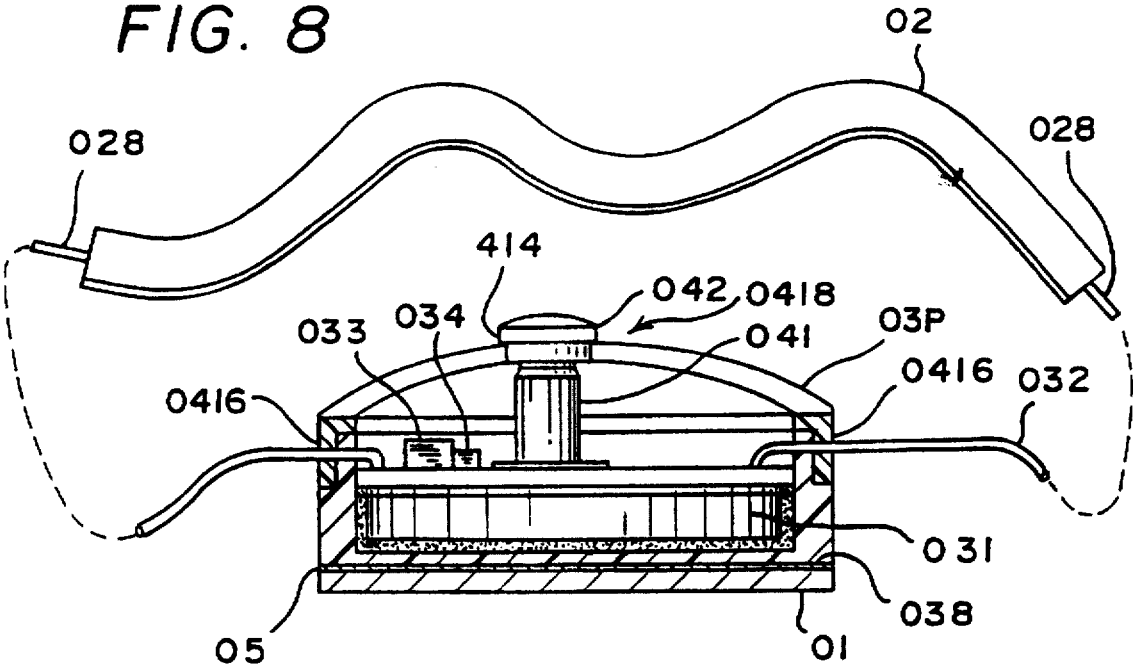
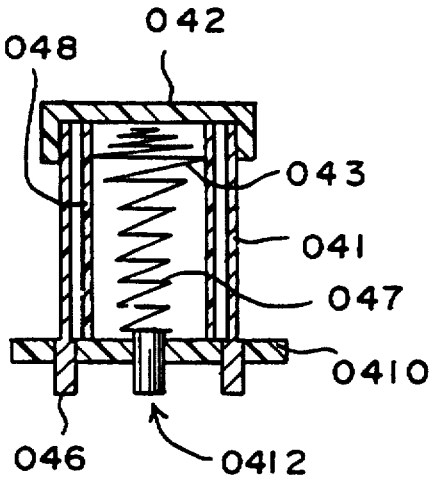
FIG. 8A
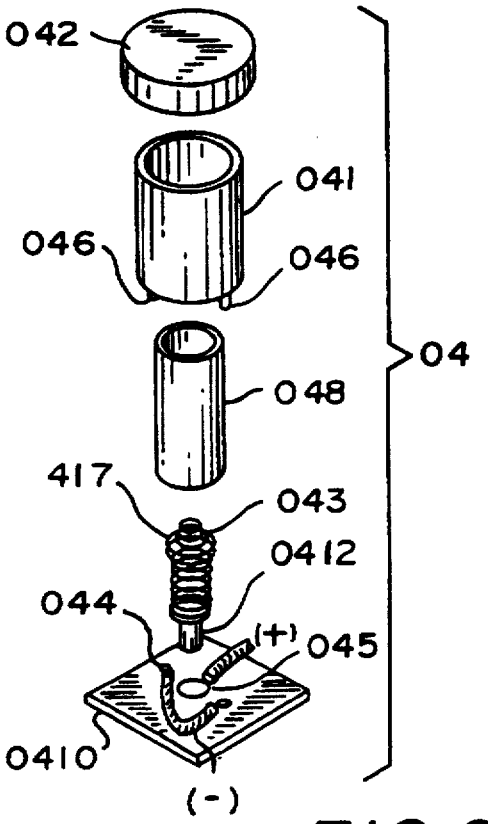
FIG. 8B

ILLUMINATED NON-MOTOR POWERED FLYING DEVICE

BACKGROUND OF THE INVENTION

1. Field of the Invention

This invention relates to a non-motor powered flying device of the type which is propelled by the user, such as a flying disc or saucer, a dart, a plastic dragonfly or bird, rubberband drive plane, gyro, badminton birdie, Velcro™ hook/loop fabric fastener or suction cup toy, and various balls, and in particular to a flying device of the aforementioned type which is illuminated. The invention also relates to a motion sensitive switch suitable for use in such a flying device.

2. Discussion of Related Art

In the past, it has generally been considered impractical to add illumination to flying devices of the above-mentioned type both because of technical difficulties and cost, and also because the conventional illumination means presented a safety hazard and/or interfered with the flying characteristics of the device.

For example, incandescent bulbs are generally unsuitable for such devices because of their relatively high volume (at least 8 mm diameter and 20 mm long) and fragility. Most small objects of the type with which the invention is concerned are intended to be used by children, and thus warnings against improper use are not likely to prevent injuries due to projection of the lighting from the object (eye injuries are of particular concern) or because of breakage of the bulbs. Also, the power consumption of conventional incandescent bulbs is relatively high (at least 100 ma), making it impossible to easily use solid state trigger circuitry to provide special effects (for example, it was previously common in the area of shoes to use a mercury switch which acts as a current load bridge to provide motion-based effects, which can present a significant health and safety hazard, and is in any case relatively bulky and cumbersome).

Light emitting diodes, while less fragile and lower in power consumption, still have the disadvantage of size (a minimum 3 mm diameter and 10 mm in length with a surface mounting height of 15 mm), and the additional disadvantages of a narrow viewing angle (at the most 45° from center), limited colors (red, green, and yellow), and relatively low brightness (red LEDs are brighter, but can confuse traffic and are prohibited in many jurisdictions). Also, LED-based lighting arrangements lack flexibility, may require a supporting circuit board which adds to the cost of the arrangement, and cannot be decorated by adding silk-screened designs or used in area lighting. Furthermore, even though LEDs are not easily broken, safety problems are not eliminated by using LEDs since the hardness of the LEDs can itself present a hazard to the user in case of impact, and the soldering points necessary to connect the LEDs to a supporting circuit board or wiring are relatively fragile and likely to fail even if the LED itself is not broken, unless protected by an expensive epoxy connection at each soldering point. Finally, although LEDs can be controlled by solid state trigger circuitry using motion sensors, the conventional motion sensor based switching systems used in such lighting arrangements are less than optimal in both size and complexity.

Paradoxically, even though LEDs have the problem of insufficient brightness, they also have the problem that the temperature of the available colors is such that the LEDs are visible under fairly bright background lighting conditions. It is actually preferable that a lighting arrangement for a flying object not be visible at light levels above 10,000 lux, to prevent drivers in lighted urban areas from being confused by all of the flying lighted objects. Furthermore, the color choice should be sufficient to prevent confusion with emergency signs, brake lights, and so forth. As a result, the color temperatures available for LEDs are generally unsuitable for the uses contemplated by the present invention. Instead, neon color-temperatures, and in particular green, blue, pink, amber, and white are best suited for the purpose of illuminating flying object, and will meet safety requirements even of jurisdictions in which red is prohibited except for emergency warnings.

In view of these problems, the Inventor has discovered that the most suitable lighting elements for use on flying objects are electro-luminescent (EL) or photo-luminescent (PL) strips, hereinafter referred to as "super-thin" lighting elements, which have none of the disadvantages of incandescent and LED based lighting arrangements. The size, flexibility, and low power consumption of these types of "super-thin" (preferably less than 3 mm thickness) makes them ideal for the applications described below. Not only can super-thin lighting arrangements based on EL or PL technology be used for illuminating small non-powered flying objects, but such lighting arrangements can be made to exhibit a variety of special effects and come in a variety of bright colors.

While EL and PL strips or panels have been known for many years, however, and despite the advantages of such lighting elements in comparison with conventional incandescent and LED-based lighting arrangements, the use of these lighting elements is far from obvious. The Inventor has been refining uses for super-thin lighting elements for some time, and has found that each application takes special techniques which would not have been apparent to the ordinary artisan, such as the use of a specially designed spring-based motion sensitive switch for achieving motion based special effects, and as a result no printed publication or patent known to the Inventor even remotely suggests the use of super-thin lighting elements in a non-motor powered (or motor powered for that matter) flying object.

U.S. Pat. Nos. 4,701,146 and 2,959,892, for example, disclose illuminated infant toys which utilize LED or incandescent lighting elements. While the objects described in these patents are not intended to be thrown, it is clear that if they are thrown, a significant potential for injury exists.

U.S. Pat. No. 4,595,200, on the other hand, discloses a sound emitting ball having a spring sensor which is inside of a top sealed dome for the purpose of activating the sound generator, while U.S. Pat. No. 3,502,831 also discloses a spring sensor, but the sensors used in these devices are relatively costly since they are discrete, in contrast to the present invention, from the switch which the ultimately operate, and also because they lack a simple means of preventing the springs from engaging the sensor and thereby wasting battery power when lighting is not desired.

Thus, the prior art discloses neither the general principle of the present invention, which is to use super-thin (EL and PL) lighting elements in non-motor powered flying objects so as to increase safety without affecting flying characteristics or greatly increasing the cost and complexity of the objects, or the improved switch which allows various motion based effects to be obtained.

SUMMARY OF THE INVENTION

It is accordingly an objective to provide a non-motor powered flying device having a lighting arrangement of the type which can safely be used on a variety of non-motor powered flying objects, including objects intended to be thrown or propelled by a racket, and which thus is capable of extending the time during which parks, beaches, playgrounds and the like can be utilized, allowing individuals to spend more time outdoors and thereby improve the health and fitness of the population.

It is a further objective of the invention to provide a non-motor powered flying object having a lighting arrangement which is flexible, multi-colored, has a wide viewing angle, uses little power, and yet is simple to construct and apply to the object.

It is a still further objective of the invention to provide non-motor powered flying object or device which is thin enough to be attached to the exterior of the object without significantly affecting the object's flying characteristics, and which is soft enough that it will not cause injuries upon impact between the object and a person, is durable and unbreakable, has a low power consumption of from 0.5 to 100 ma (0.09 ma/cm$^2$), is capable of using any mechanical or electrical switch, is capable of providing a variety of different light performances, is available in a variety of colors with relatively high brightness, can be printed with a variety of different designs, logos, and so forth, is bendable and can be easily attached to a variety of soft materials to provide area wide lighting at any desired location.

It is yet another objective of the invention to provide an improved resilient spring-type motion sensitive switching arrangement suitable for use on a user-propelled non-motor powered flying object in order to obtain a practical and low cost lighted flying device for use in a dark environment, and which includes a simple means of preventing the poles of the switch from engaging each other when lighting is not desired.

Briefly, these objectives of the invention are achieved by attaching, to a non-motor powered flying device of the type designed to be thrown, kicked, hit, or otherwise propelled by the user, a lighting arrangement in the form of a super-thin lighting element such as an electro-luminescent or photo-luminescent strip or panel. In the case of an electro-luminescent strip or panel, the power supply is positioned so as to enhance or at least not interfere with the flying properties of the object or device, and may include a specially designed spring-based motion sensitive switch which can be deactivated by inserting a straw-like member between the poles of the switch. In an especially preferred embodiment of the invention, the deactivating member of the motion sensitive switch is attached to a rubber plug which provides a handle for the member and also serves to seal the opening in the switch housing through which the member is inserted.

BRIEF DESCRIPTION OF THE DRAWINGS

FIGS. 6A, 6B, and 6C to 6G are perspective views of various balls constructed in accordance with the principles of the invention.

FIG. 8 is a cross-sectional view of a switch and circuit board design in a housing with a two wire outlet to the super-thin light means according for use in the preferred embodiments illustrated in FIGS. 1–7.

FIG. 8A is a second cross-sectional view of the switch illustrated in FIG. 8.

FIG. 8B is an exploded perspective view of the switch shown in FIGS. 8 and 8A.

DETAILED DESCRIPTION OF THE PREFERRED EMBODIMENTS

Figure 1:
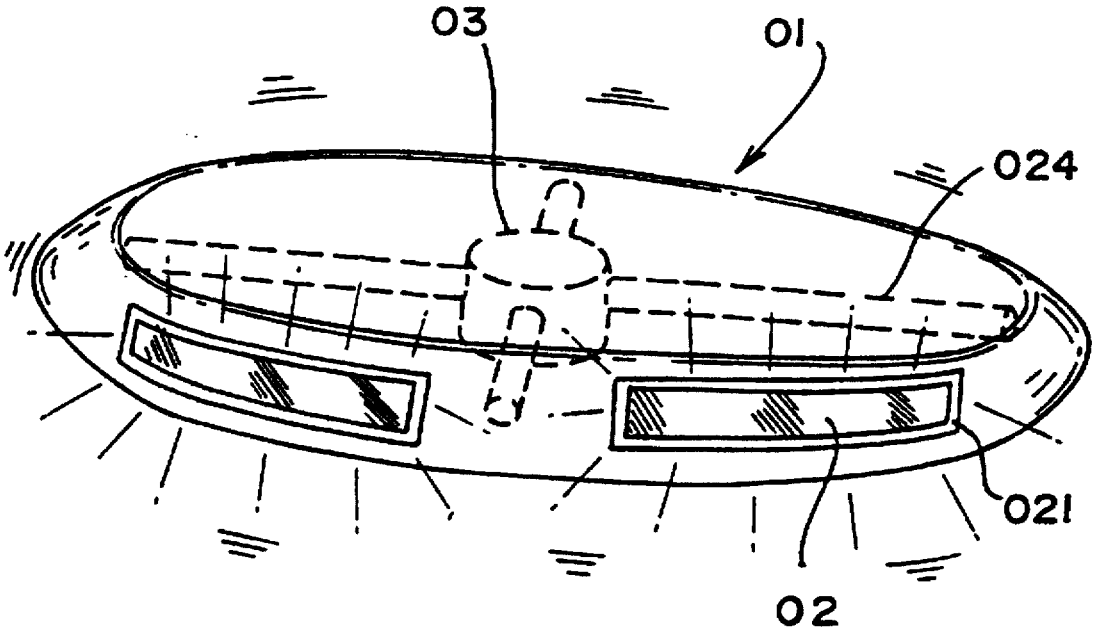
FIG. 1 is a perspective view of a lighted flying disc device constructed in accordance with the principles of a preferred embodiment of the invention.

The preferred embodiments of the invention all involve some type of non-motor powered flying device. The phrase "non-motor powered flying device" is intended to cover a variety of different devices which have in common that they are airborne for only short periods of time, that they are relatively small and can be handled by an individual, and that the forward motion of the device is ultimately supplied by the individual user of the device, whether by tensioning an elastic device such as a rubber band, or by hitting (directly or by means of a paddle, racket, or bat), throwing, or kicking the object.

A principal feature of the invention is to use a device referred herein as a "super-thin light means," defined as a light having a thickness of less than 2 mm. At present, the only lighting elements which are known to fit the super-thin requirements are electro-luminescent (EL) and photoluminescent (PL) light panels or strips, although it is possible that analogous types of lighting elements will become available in the future. As noted above, super-thin lighting elements are advantageous for the purposes of the invention not only because their use will not interfere with the aerodynamic characteristics of the object to which they are attached, but also because super-thin lighting elements can in general be easily affixed to any type of hard or soft surface by stitching or gluing, and be silk-screened or printed with a variety of designs, patterns, or wording, with transparent, partially transparent, or opaque ink for a variety of decorative effects. Because a super-thin lighting element is flexible, it can follow the shape of the surface, and further can be cut and applied by a variety of stitching techniques to resemble a variety of fabric-like patterns and configurations, including attachment in a manner analogous to a hem, lace, frill, or welt. In the case of a flying disc, for example, the super-thin light means can be put along the perimeter of a transparent inner part of the disc, or on the outside of a non-transparent disc. In the case of a ball, the super-thin light means can be placed along an arc or chord of the surface, with a curved or linear shape. In the case of a throwing dart, the light means can be arranged around the circumference of a holding tube, or in the tail assembly. Also, as an alternative to stitching, a super-thin lighting element can be attached by means of tape, Velcro™, welding and a variety of other known methods of attaching a thin material to another object.

Of course, the inclusion of a lighting element in a flying object is useless if a power source is not included (although those skilled in the art will appreciate that PL, in contrast to EL, lighting elements do not require a power source). As a result, for the case where the lighting element is an EL strip or panel, the invention uses a circuit board with a self-contained battery, electric components, a transformer, a switch, and a housing. The principal purpose of the circuitry is to convert the DC current supplied by the battery into a form suitable for triggering the light means, and to provide other special effects if desired, including steady state, flashing, control of a plurality of different light means with chasing, random, fade-in and fade-out, and other special effects. In addition, the circuitry includes a switch used to turn the system on and off whenever the light is needed, with all components being contained in the housing, which is preferably waterproof or environmentally sealed and may have a variety of shapes and is easily attached to the objects.

The preferred switch is a spring type motion switch, as will be explained in more detail below in connection with FIGS. 8, 8A, and 8B, which turns the light on based on motion. This is to be distinguished from prior motion sensors, such as those disclosed in U.S. Pat. Nos. 4,595,200 and 3,502,831, which are not used as a switch to turn on an illumination means in a flying object. The preferred switch includes a spring forming a first terminal which contacts the wall of a metal cylinder forming the second terminal of the switch when the switch is set in motion by inertia upon flying of the object.

Figure 7:
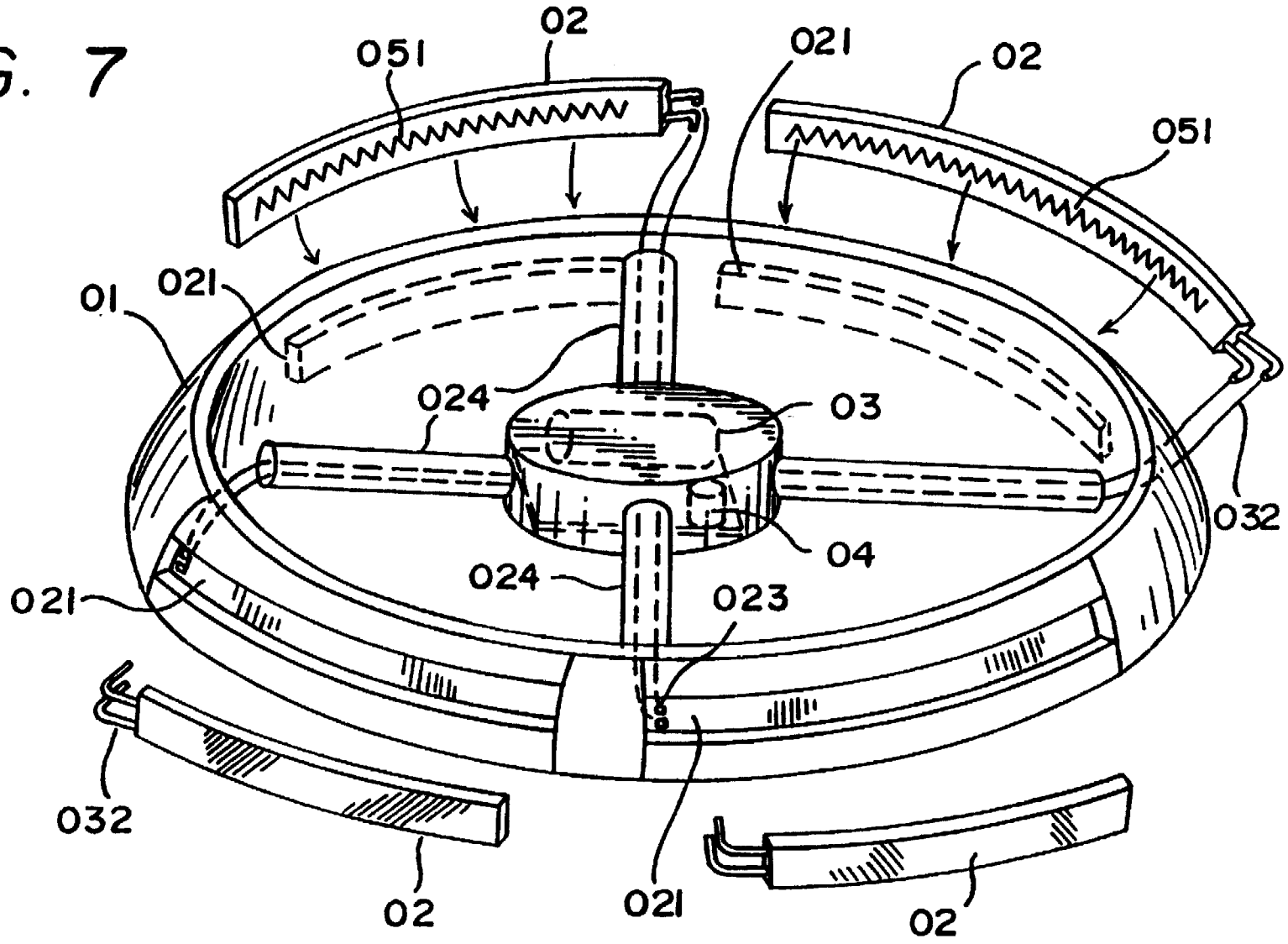
FIG. 7 is an a perspective view showing the manner in which the flying disc illustrated in FIG. 1 is assembled.

Turning now to specifics of the various preferred embodiments of the invention, FIGS. 1 and 7 show a flying disc main body 1 having attached thereto four individual lighting elements 2 on the outside circumference of the disc and, in the case where the lighting elements are EL strips or panels as opposed to PL strips or panels, a circuit board 3 located at the center of the disc so as to not affect the flying properties of the disc. Preferably, circuit board 3 is contained within a housing of the type shown in FIG. 8, although inclusion of the circuit board in a housing is not absolutely necessary to the function of the invention in its broadest form. Those skilled in the art will appreciate that the disc may be in the form of a Frisbee™-like toy, or any other object which is designed to be propelled through the air.

Each of the lighting elements for the flying disc of this preferred embodiment of the invention, as best illustrated in FIG. 7, includes a pair of terminals 28 connected to the circuit board 3 via wires 32 through tubes 24 which serve as structural supports of the disc. Preferably, the periphery of the disc is fluted, i.e., contains grooves 21, into which the lighting elements are fitted to be flush with the outer circumference of the disc, with wires 32 passing into the interior of the disc through holes 23, and the strips being secured in the flutings or grooves 21 by an adhesive such as Velcro™. While details of the circuitry on circuit board 3 are discussed in more detail below in connection with FIG. 9, it is noted that in this embodiment of the invention, the circuitry includes a motion sensitive switch 4.

The remaining preferred embodiments of the invention, as illustrated, share a number of features with the embodiment shown in FIGS. 1 and 7, including the use of flutings or grooves 21 to mount the lighting elements 2 in some kind of main body 1 whose shape can take a variety of forms, and the inclusion of a circuit board 3 if the lighting element is an EL strip rather than a PL strip, although those skilled in the art should appreciate that many of the illustrated details may be freely varied by the skilled artisan and still follow the principles of the invention. However, it should be appreciated that all of the preferred embodiments of the invention also share certain principles which cannot be varied, namely the use of super-thin lighting elements and their arrangement in a way which will not negatively affect the flying characteristics of the object to which they are applied, or present a safety hazard to persons in the path of the object.

Figure 2:
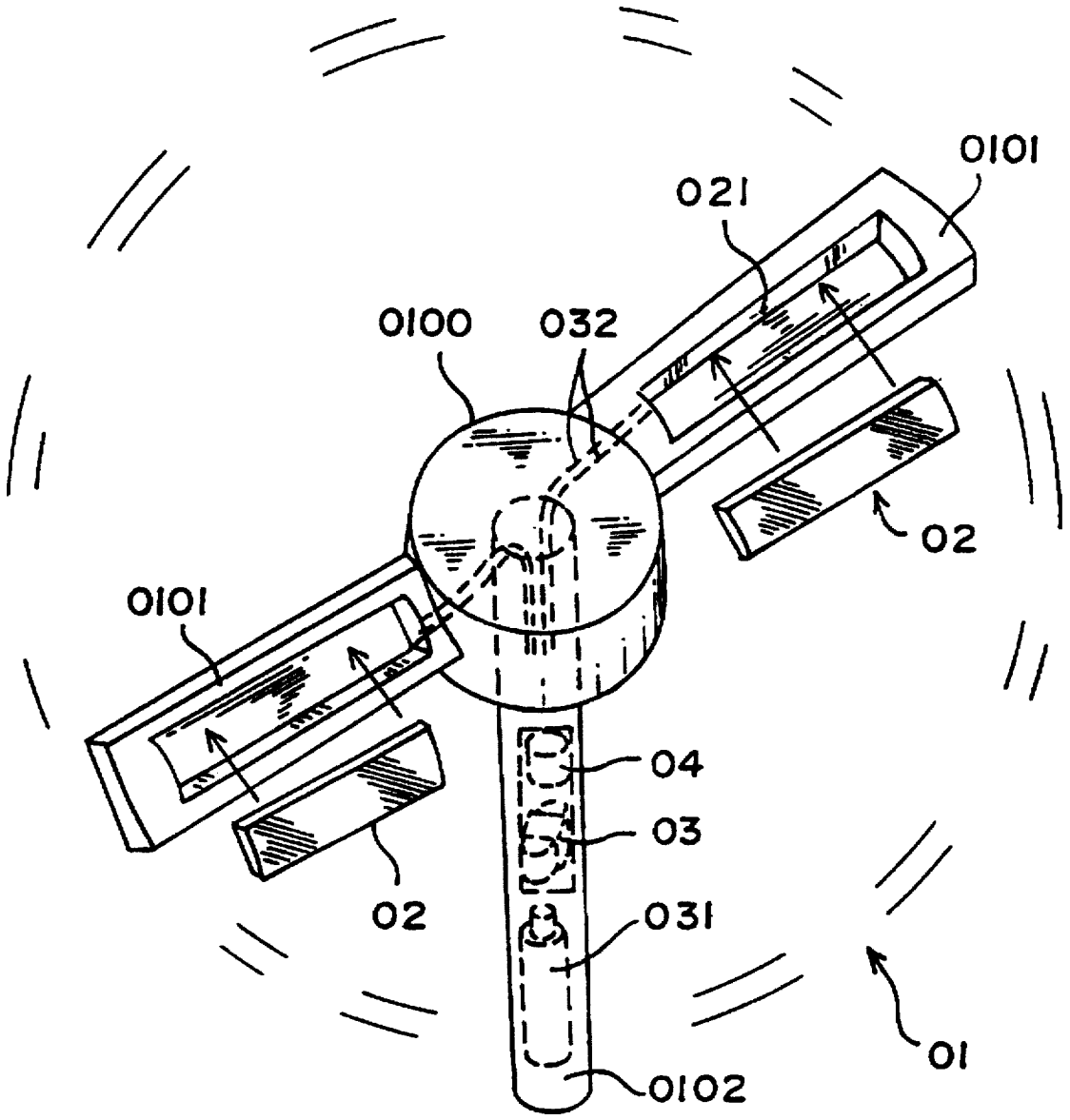
FIG. 2 is a perspective view of a plastic dragonfly constructed in accordance with the principles of the preferred embodiment of the invention.

FIG. 2, for example, shows a flying "dragonfly" toy having a main body 100, wings 101, and a tubular base 102 arranged in such a manner that when the tubular base is twisted and then released, the wings main body are caused to spin, which causes the device to fly. In order to provide the advantages described above, the lighting elements 2 situated in flutings or grooves 21 on the wings of the dragonfly are powered and controlled by a circuit board 3, switch 4, and battery 31 situated in the tubular base 102 of the device by spring switch 4.

Figure 3:
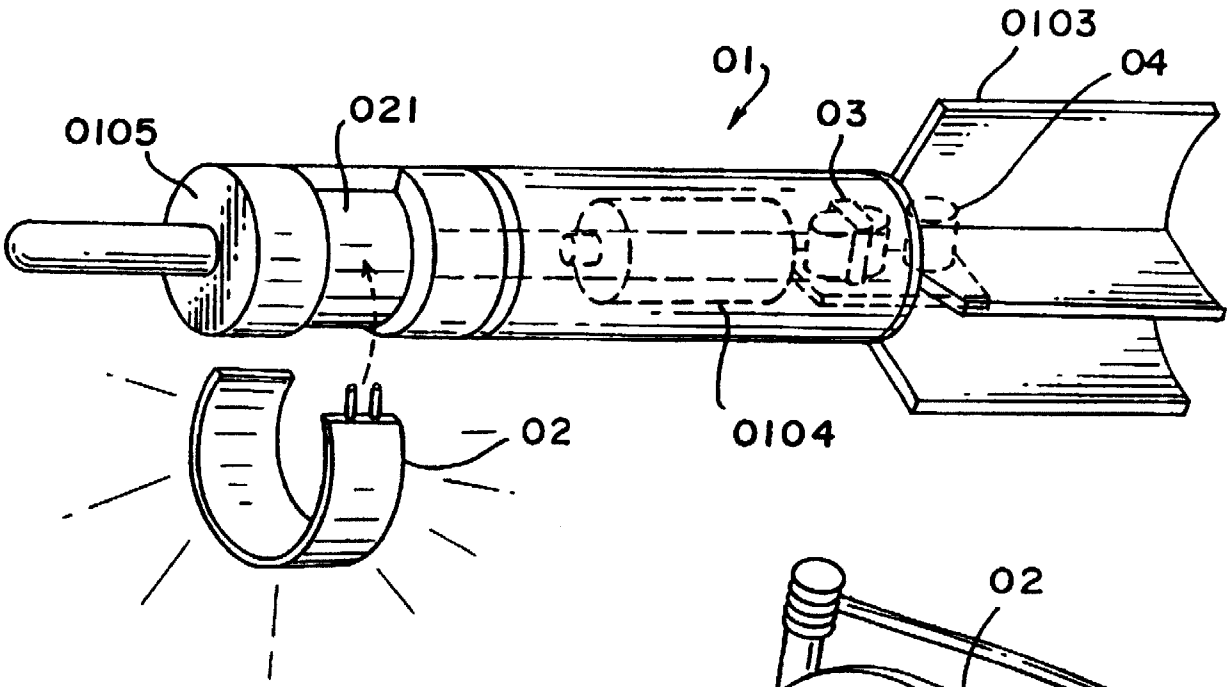
FIG. 3 is a perspective view of a throwing dart constructed in accordance with the principles of a preferred embodiment of the invention.

In contrast, in the throwing dart of FIG. 3, which includes a tail section 103, a tubular main body or fuselage 103, and a nose section 105, the lighting element 2 is situated in groove 21 near nose 105 on the tubular body 104 of the device and connected with a circuit board positioned within the tubular body to control the lighting element by means of spring switch 4. Those skilled in the art will of course appreciate that in this and the other illustrated designs, while proper placement of the circuitry and battery is important to the aerodynamic characteristics of the device, the lighting element may be placed at virtually any desired location on the surface of the device and, if there is sufficient room, may even be placed within the device to be visible through openings, transparent, or partially transparent sections of the device.

Figure 4:
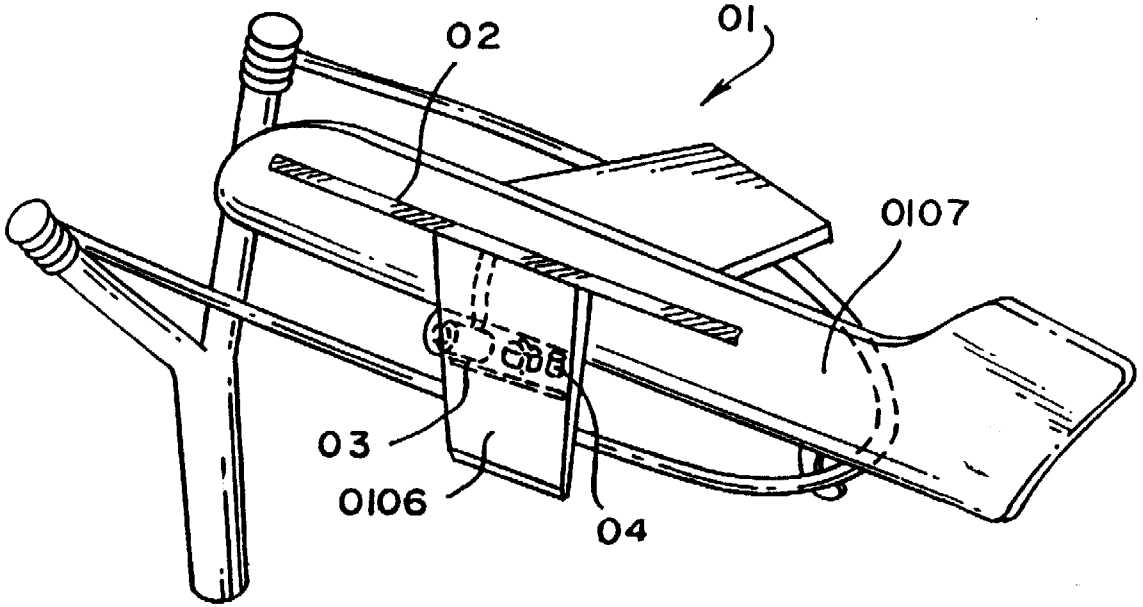
FIG. 4 is a perspective view of the glider of a fourth preferred embodiment of the invention.

The glider of FIG. 4, which may be slingshot launched as illustrated or hand launched, unlike the flying disc and dart of FIGS. 1 and 2, on the other hand, does not include an interior section, but rather is made up of wings 106 and a solid fuselage 107. In this situation, with the lighting elements situated on the side of the glider, the circuit board 3 and spring switch 4 may advantageously be made part of the overall design of the glider and giving these elements the appearance of a wing-launched bomb, torpedo, or missile.

Figure 5:
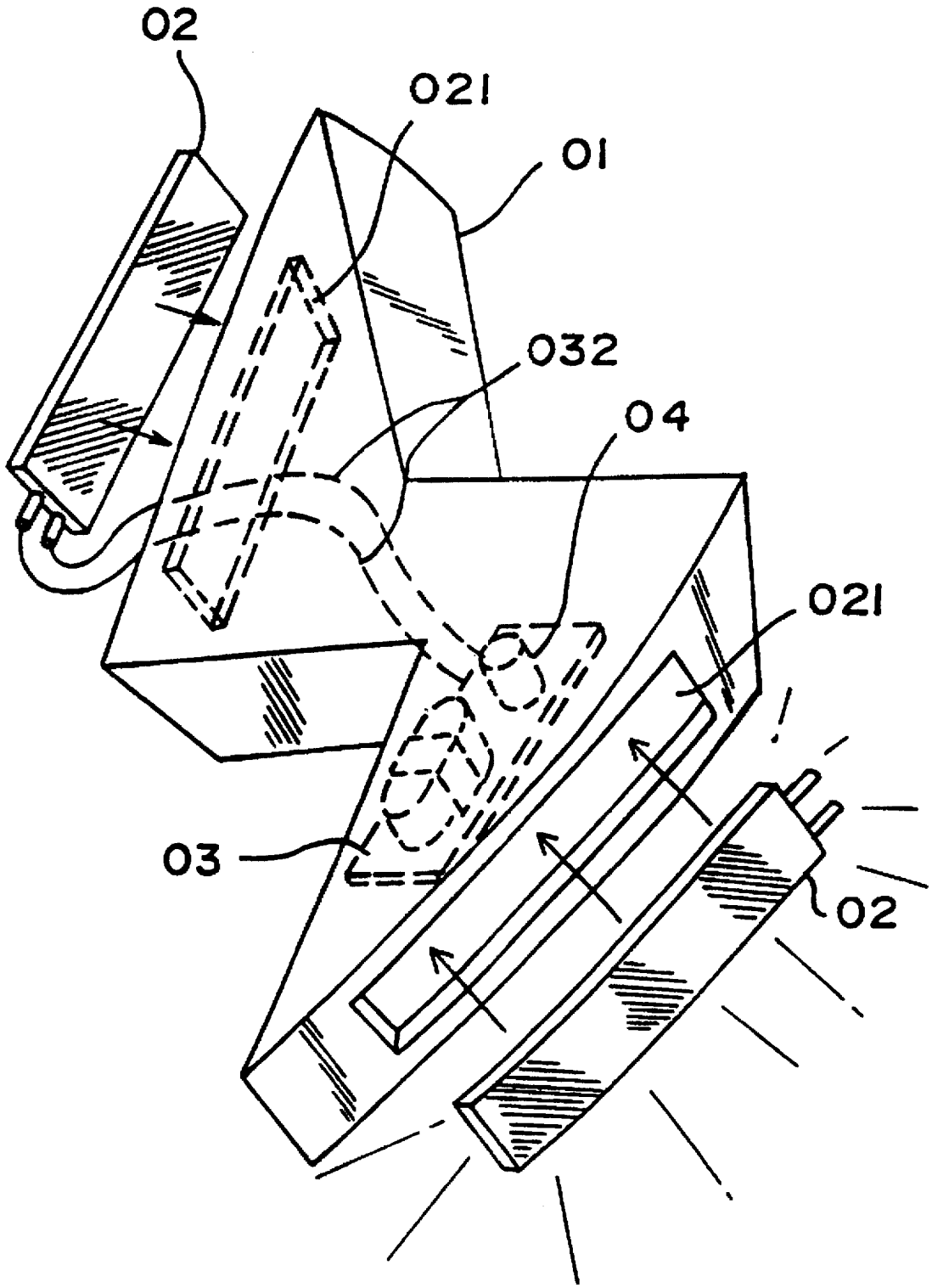
FIG. 5 is a perspective view of a "martial dart" constructed in accordance with the principles of a fifth preferred embodiment of the invention.

In each of the previously described embodiments of the invention, the circuitry and power supply have been placed as close to the center of gravity of the object as possible. However, in the "martial dart" illustrated in FIG. 5, to which is attached two lighting elements 2 in grooves 21 on the surface of the lightning shaped main body, the circuit board and its are housing arranged on one side of the object to shift the center of gravity into an unbalanced position and thereby assist in the rotation of the object when it is thrown.

Finally, with respect to the various forms the flying object of the invention can take, FIGS. 6C to 6G all illustrate various ball-like flying objects designed to be thrown or propelled through the air by, for example, the paddles or rackets illustrated respectively in FIGS. 6A and 6B. The illustrated balls have in common a sticky material 52, such as Velcro™ hooks, on the surface of the device, which cooperates with a corresponding material such as Velcro™ loops 51 on one surface of the paddle or racket, to make throwing and catching easier for young children and for recreational use. In this type of device, the super-thin light means is easily attached to the surface of the device by stitching, while the circuit board and housing can easily be placed within the object to prevent injuries.

Figure 9A:
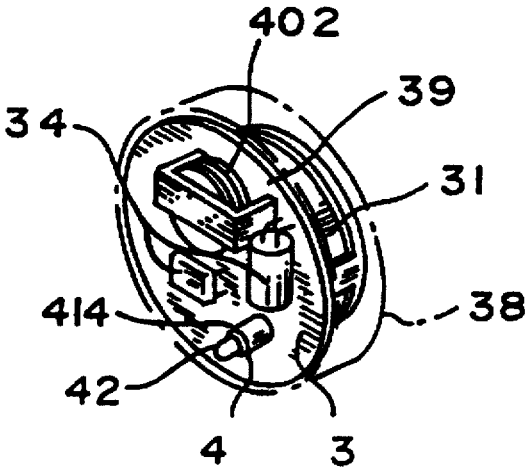
FIG. 9A is a perspective view of the housing also illustrated in FIG. 8 for housing the circuitry of FIG. 9.

Turning now to the details of the motion sensitive switch 4 and associated housing and circuitry used in connection with the EL version of the various preferred embodiments of the invention, FIGS. 8 and 9A shows that the switch is mounted on circuit board 3, which also has mounted thereon a transformer 33 and various other electrical components 34, and to which are connected the wires 32 leading from the terminals 28 of the individual lighting elements 2. Wires 32 enter the circuit board housing via openings 416 in an upper housing half 38, the lower housing half 39 being separable from the upper housing half 38 by twisting to enable the user to access battery 31 mounted below the circuit board 3 to provide an exceptionally compact and efficient arrangement. Preferably, the lower housing half 39 is attached to the body 1 of the object in question by an attachment means 5 which can be in any convenient form. If the housing is to be removable, Velcro™ provides an especially convenient attachment means.

The switch 4 itself is made up of a cylindrical outer metal housing 41 mounted on a base 412 and which forms one pole of the switch and is connected to traces on the circuit board by terminals 46. The other pole of the switch is a flexible metal coil spring 43 connected to another trace on the circuit board by a terminal 412. The switch 43 as illustrated has more and wider coils at the free end 417 than at the terminal end, as a result of which the inertia of the free end of the switch causes it to flex whenever the switch is moved so as to contact housing 41 and thereby complete a circuit between terminals 46 and 412 which are respectively connected to the negative and positive terminals of the power supply.

Uniquely, in order to prevent wastage of the battery power when lighting effects are not desired, the spring switch 4, a cylindrical isolating member 48 is provided which can be placed between the metal cylinder 41 and the spring 43 so as to prevent the spring from engaging the housing and establishing a connection between the poles of the switch. Advantageously, cylinder or straw 48 is inserted through the upper housing of the circuit board assembly through an opening 414 and is attached to a rubber plug 42 which provides a handle for inserting and withdrawing the cylinder and also seals the opening against moisture when the object is not use. As a result, the invention provides an especially compact motion sensitive switch arrangement which consists of only a base, a coil spring, an outer metal cylinder, and a rubber plug with a straw or cylinder attached thereto for providing motion-sensitive control of the lighting element when desired, and for protecting the circuitry and preventing wastage of power when lighting is not desired.

Figure 9:
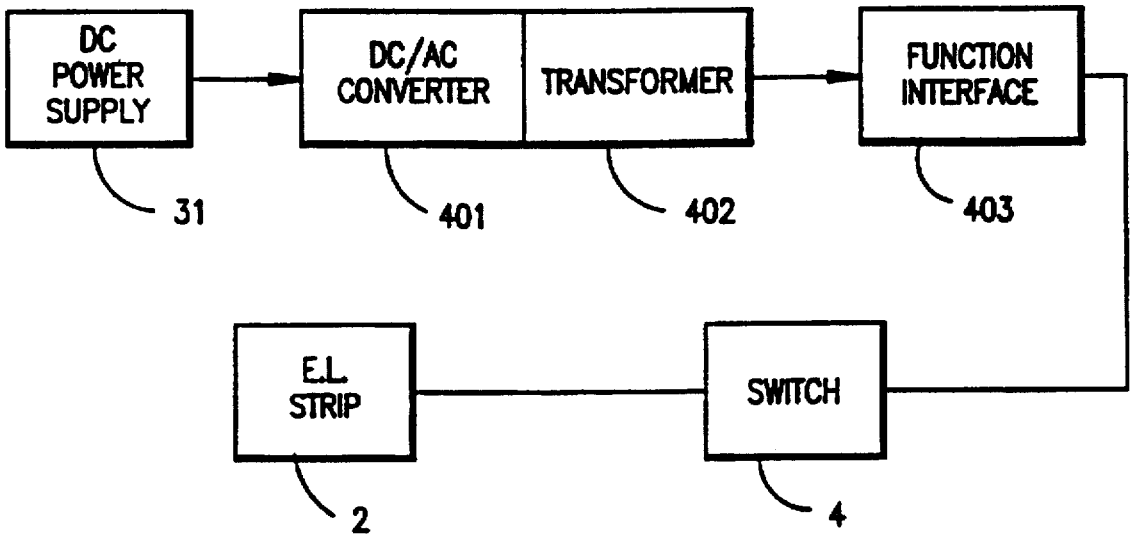
FIG. 9 is a functional diagram of the illumination means and circuitry for use in the embodiments of FIGS. 1–7.
Figure 10:
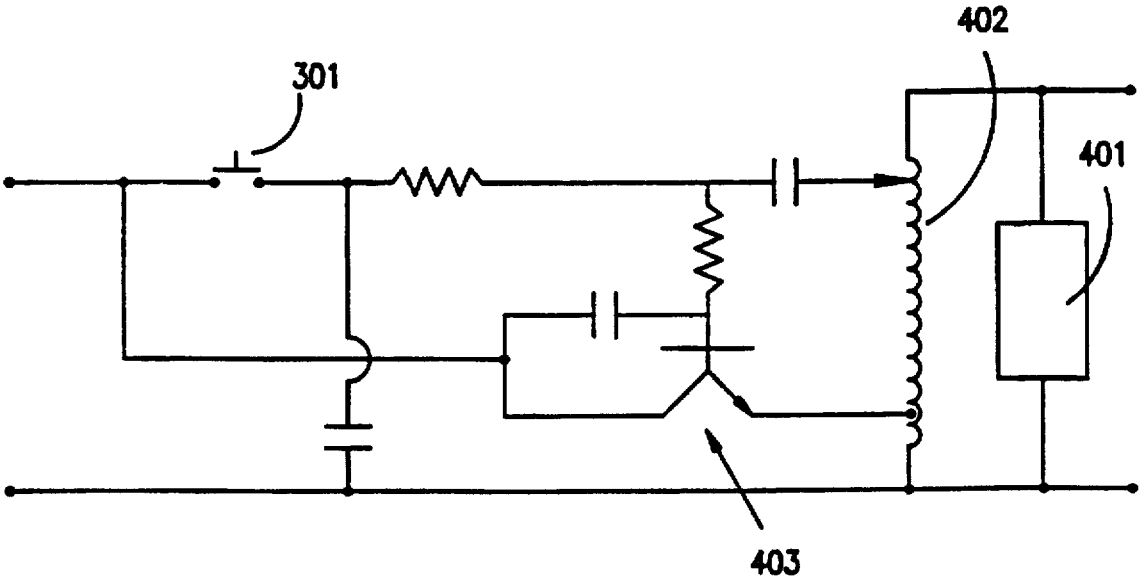
FIG. 10 is as schematic diagram showing details of the circuitry illustrated in FIG. 9.

Turning now to the circuitry shown in FIGS. 9 and 10, DC power supply 31 is electrically connected to the lighting element 2 via a circuit which includes a DC/AC converter 401 electrically connected with a transformer 402, transformer 402 being further electrically connected with a function interface 403 and, via parallel connected switch 4, to the lighting element 2. Those skilled in the art will appreciate that the battery in this embodiment of the invention can be a rechargeable battery which can be charged by a device having a higher voltage output than the battery's, and that the direct current supplied by DC power source 31 is thus converted into an alternating current of a desired frequency by DC/AC converter 401 and supplied to the transformer 402 for increasing the voltage of the alternating current, and then transmitted from the transformer 402 to the function interface 403. Function interface 403 provides a number of preset or switchable options for turning on the lighting element 2, e.g., steady, flash, sequential or random, and may take any desired form from a simple circuit as illustrated in FIG. 10 to a microprocessor, depending on the complexity of the special effects to be exhibited. Those skilled in the art will appreciate that the number of options is greatly increased if a multiple element strip such as the one disclosed in copending U.S. patent application Ser. No. 08/305,294 is utilized.

Having thus described several preferred embodiments of the invention and a number of variations and modifications of the preferred embodiments, it is anticipated that still further variations and modifications will undoubtedly occur to those skilled in the art upon reading the above description. For example, while the lighting element can be turned on and off by means of the specially designed motion sensitive switch 4, it may also be desired to include or substitute a photosensitive or manual, solid state or mechanical switch to turn the light on and off upon the occurrence of external events such as nightfall or simply at the whim of the user. It is therefore intended that the invention not be limited by the above description, but rather that it be interpreted, in accordance with the appended claims, to cover all such variations and modifications which fairly fall within the scope of the invention.

We claim:

1. A non-motor powered flying object of the type designed to be thrown, kicked, hit, or otherwise manually propelled, either directly or indirectly, comprising:

a body having flying characteristics;

a super-thin flexible photo-luminescent lighting element; and means for attaching the lighting element to the body without degrading the flying characteristics of the body.

2. A non-motor powered flying object of the type designed to be thrown, kicked, hit, or otherwise manually propelled, either directly or indirectly, comprising:

a body having flying characteristics;

a super-thin flexible electro-luminescent lighting element;

means for attaching the lighting element to an exterior of the body without degrading the flying characteristics of the body; and a circuit board including circuitry for providing power to the lighting element, wherein the circuitry is positioned so as not to degrade the flying characteristics of the body, and wherein the circuitry includes means for converting DC power to AC power and supplying the AC power to the electro-luminescent lighting element, and a motion sensitive switch.

3. A non-motor powered flying object as claimed in claim 2, wherein the exterior of the body includes a recess and the lighting element is positioned in the recess so that an exposed surface of the lighting element is flush with an exterior surface of the body, and wherein the circuit board and power supply are positioned inside the body.

4. A non-motor powered flying object as claimed in claim 2, wherein the motion sensitive switch comprises a conductive cylinder and a conductive spring positioned inside the cylinder to directly contact the cylinder and complete a circuit when the flying object is in motion.

5. A non-motor powered flying object as claimed in claim 4, wherein the spring is a coil spring.

6. A non-motor powered flying object as claimed in claim 4, wherein the motion sensitive switch is mounted in a housing having an opening, and further comprising an insulating cylinder arranged to be inserted through the conductive cylinder and to fit between the spring and the conductive cylinder in order to prevent contact between the spring and the conductive cylinder.

7. A non-motor powered flying object as claimed in claim 6, wherein the insulating cylinder is attached to a rubber plug which seals said opening when the insulating cylinder is inserted through the opening to isolate the spring and the conductive cylinder.

8. A non-motor powered flying object as claimed in claim 2, wherein the flying object is a flying disc.

9. A non-motor powered flying object as claimed in claim 8, further comprising a circuit board for supplying power to the lighting element and which is positioned centrally inside the disc.

10. A non-motor powered flying object as claimed in claim 2, wherein the flying object is a dragonfly toy.

11. A non-motor powered flying object as claimed in claim 2, wherein the flying object is a throwing dart.

12. A non-motor powered flying object as claimed in claim 2, wherein the flying object is a lightning-shaped martial arts dart.

13. A non-motor powered flying object as claimed in claim 12, further comprising a circuit board for supplying power to the lighting element and which is positioned away from a center of gravity of the dart.

14. A non-motor powered flying object as claimed in claim 2, wherein the flying object is a glider.

15. A non-motor powered flying object as claimed in claim 14, further comprising a power supply for the lighting element and which is positioned below a wing of the glider to appear as a bomb, torpedo, or missile.

16. A non-motor powered flying object as claimed in claim 2, wherein the flying object is a ball.

17. A non-motor powered flying object as claimed in claim 16, wherein the ball has a sticky material attached thereto for making the ball easier to catch, and wherein the lighting element is stitched to a surface of the ball.

18. A non-motor powered flying object as claimed in claim 2, further comprising a power supply connected to the lighting element via a mechanical or electronic switch.

19. A non-motor powered flying object as claimed in claim 2, wherein the attachment means comprises a means selected from the group consisting of glue, tape, welding, and Velcro™ hook/loop fabric fastener.

20. A non-motor powered flying object as claimed in claim 2, wherein the lighting element has a surface at least partially covered with silk-screened elements.

21. A non-motor powered flying object as claimed in claim 20, wherein the silk-screened elements are made up of varying transparencies of ink.

22. A motion sensitive switch mounted in a housing having an opening, comprising a conductive cylinder, a conductive spring positioned inside the cylinder to contact the cylinder and complete a circuit when the housing is in motion, and an insulating cylinder mounted on a handle and arranged within the conductive cylinder and adapted to be removed from the conductive cylinder and to fit between the spring and the conductive cylinder in order to prevent contact between the spring and the conductive cylinder.

23. A motion sensitive switch as claimed in claim 22, wherein the insulating cylinder is attached to a rubber plug which seals said opening when the insulating cylinder is inserted through the opening to isolate the spring and the conductive cylinder.

* * * * *